United States Patent [19]

Ellison

[11] Patent Number: 4,782,982

[45] Date of Patent: Nov. 8, 1988

[54] SELF-PRESSURIZING SPRAYER

[75] Inventor: Garry L. Ellison, Grand Rapids, Mich.

[73] Assignee: Root-Lowell Manufacturing Company, Lowell, Mich.

[21] Appl. No.: 58,519

[22] Filed: Jun. 5, 1987

Related U.S. Application Data

[63] Continuation-in-part of Ser. No. 3,469, Jan. 15, 1987.

[51] Int. Cl.[4] ..... B65D 83/14; B05B 9/04

[52] U.S. Cl. ..... 222/1; 222/394; 222/401; 141/2; 141/18; 239/352; 239/373

[58] Field of Search ..... 222/402.16, 399, 394, 222/1, 396, 397, 401, 373, 395, 478, 482; 422/283, 266; 141/18, 20, 2, 382, 383, 387, 4–6; 47/1.5; 239/352, 373, 302; 137/209; 169/76, 74

[56] References Cited

U.S. PATENT DOCUMENTS

| | | | |
|---|---|---|---|
| 194,597 | 8/1877 | Hearle | 222/399 |
| 1,078,028 | 11/1913 | Zeamans | 222/640 |
| 1,246,227 | 11/1917 | Bouvin | 222/394 X |
| 1,299,567 | 4/1919 | Farr | 222/395 |
| 2,501,260 | 3/1950 | Brodin | 47/1 R |
| 2,645,381 | 7/1953 | Lattman | 222/401 X |
| 2,750,752 | 6/1956 | Yorgey, Jr. | 222/397 |
| 3,109,566 | 11/1963 | Yetter | 222/394 |
| 3,245,583 | 4/1966 | Miller et al. | 222/399 |
| 3,718,165 | 2/1973 | Grothoff | 141/20 |
| 3,790,039 | 2/1974 | Zucconi | 222/394 |
| 4,431,117 | 2/1984 | Genbauffe et al. | 222/394 X |

*Primary Examiner*—Joseph A. Rolla
*Assistant Examiner*—Nils E. Pederson
*Attorney, Agent, or Firm*—Price, Heneveld, Cooper, DeWitt & Litton

[57] ABSTRACT

A portable sprayer which has a resealable lid and a one-way valve attached to a receptacle. As the receptacle is filled with fluid through the one-way valve, air which is entrapped in the receptacle pressurizes the container to facilitate dispensing the fluid.

19 Claims, 8 Drawing Sheets

SELF-PRESSURIZING SPRAYER

CROSS REFERENCE TO RELATED APPLICATION

This is a continuation-in-part of U.S. Ser. No. 003,469 entitled SELF-PRESSURIZING CHEMICAL SPRAYER, filed Jan. 15, 1987, now abandoned.

BACKGROUND OF THE DISCLOSURE

This invention relates to sprayers, particularly small, portable sprayers which are often used around homes or in light industrial applications. Such sprayers and liquid dispensers require manual pressurization before the liquid therein can be dispensed. After filling to a designated line with water, a chemical solution or other liquid to be dispensed, the sprayer is pressurized by a hand pump prior to dispensing. Such hand pump pressurized sprayers have been the industry standard for small, portable sprayers for many, many years.

SUMMARY OF THE INVENTION

The sprayer of the present invention is fitted not only with valved dispensing means as is common for such sprayers, but also with a one-way filling valve adapted for connection to a pressurized source of the liquid to be dispensed from the sprayer whereby filling the sprayer with the liquid simultaneously serves to pressurize the sprayer. Thus for example if water is to be sprayed, a hose connected to the building or home water system can be coupled to the one-way valve so that as the sprayer is filled with water, the pressure of the home or building system is conveyed to the sprayer itself. If desired, chemicals can be introduced into the sprayer ahead of the water or other diluent to be added under pressure so that a desired solution can be dispensed with the sprayer.

These and other objects, advantages and features of the present invention will be more fully understood and appreciated by reference to the written specification and appended drawings.

BRIEF DESCRIPTION OF THE DRAWINGS

Preferred embodiments of the invention have been depicted for illustrative purposes wherein.

DESCRIPTION OF THE PREFERRED EMBODIMENT

Figure 1:
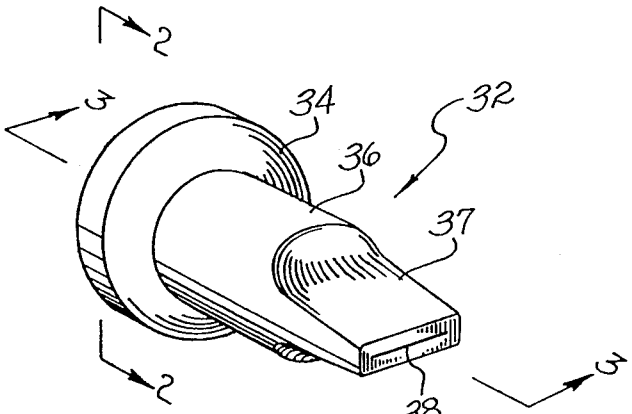
FIG. 1 is a perspective view of a one-way valve which can be used in the sprayer of this invention.

The preferred embodiment herein described is not intended to be exhaustive or to limit the invention to the precise form disclosed. It is chosen and described to illustrate the principles of the invention and its application and practical use to thereby enable others skilled in the art to utilize the invention.

Referring now to FIGS. 4–7, reference numeral 10 generally designates the self-pressurizing sprayer of this invention. Sprayer 10 includes a receptacle 12 formed of polyethylene or the like and a closure cap 14 which may be removably secured to receptacle 12 by threads 18. Cap 14 may include as an integral part thereof a spray nozzle 20 which communicates with the fluid contained in receptacle 12 and a trigger 22 which operates a valve (not shown) to allow fluid under pressure to be dispensed through the nozzle.

Figure 3:
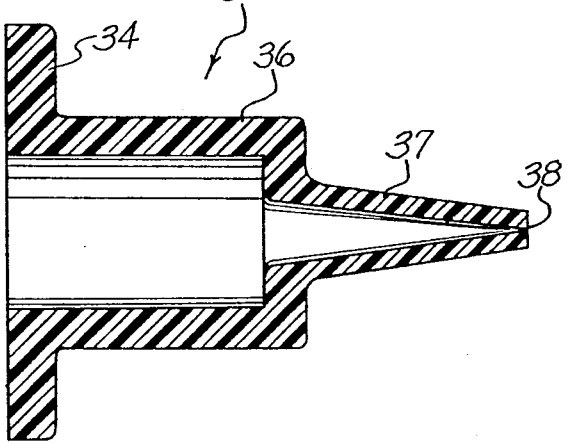
FIG. 3 is a cross-sectional view taken along plane III—III of FIG. 1.
Figure 2:
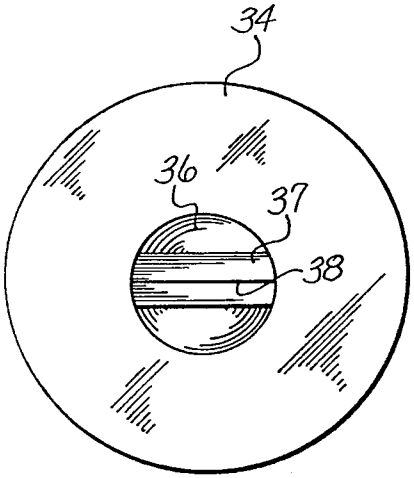
FIG. 2 is an end view of the valve as seen from plane II—II of FIG. 1.
Figure 4:
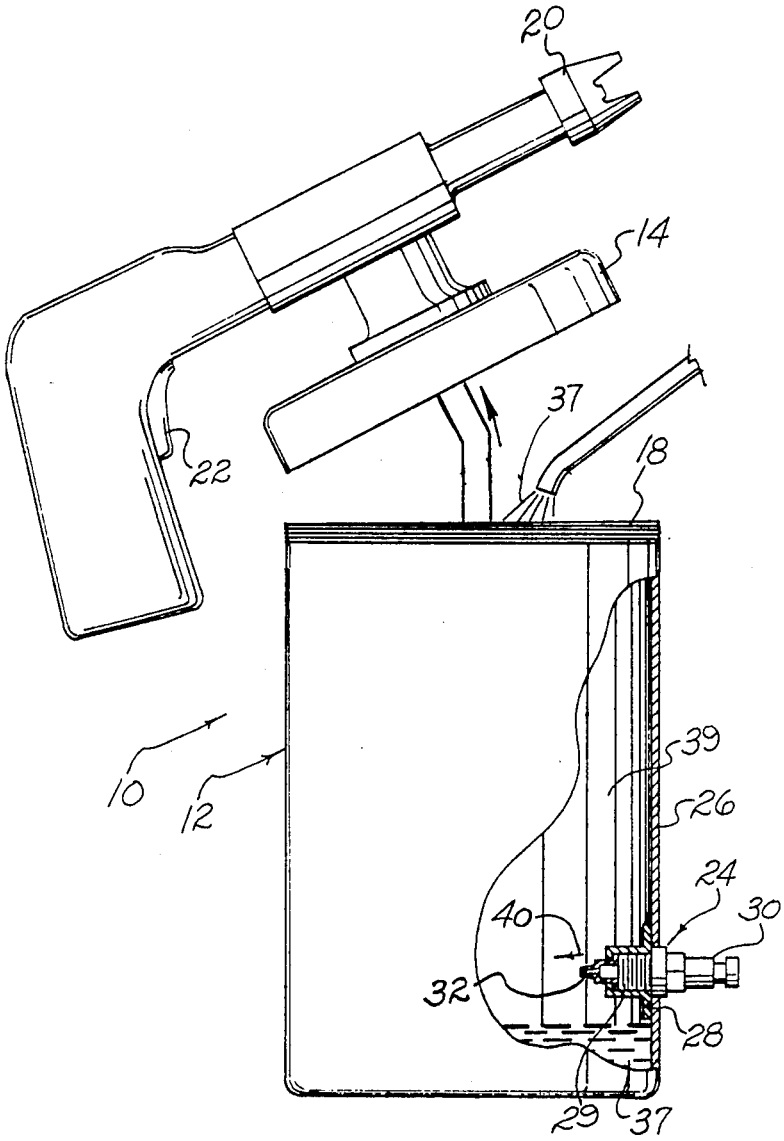
FIG. 4 is an elevational view of one embodiment of a sprayer in accordance with the present invention with the top removed and portions broken away for illustrative purposes.
Figure 5:
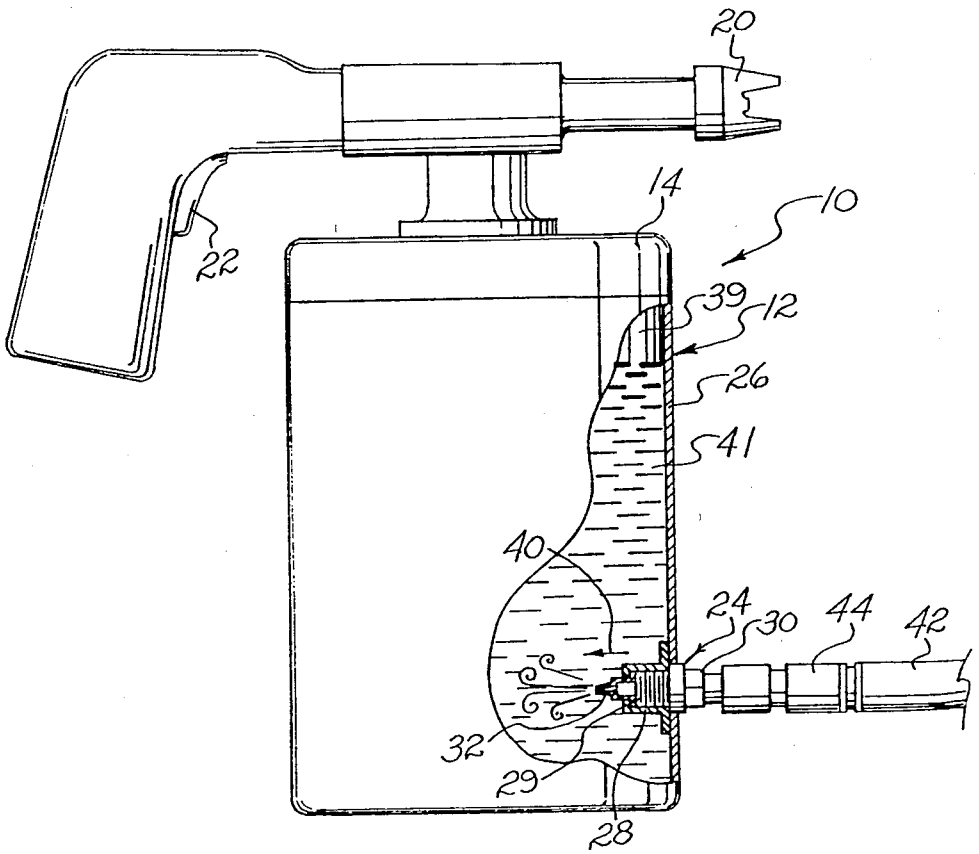
FIG. 5 is an elevational view similar to FIG. 4 showing the top closed and the container being filled with diluent under pressure.
Figure 6:
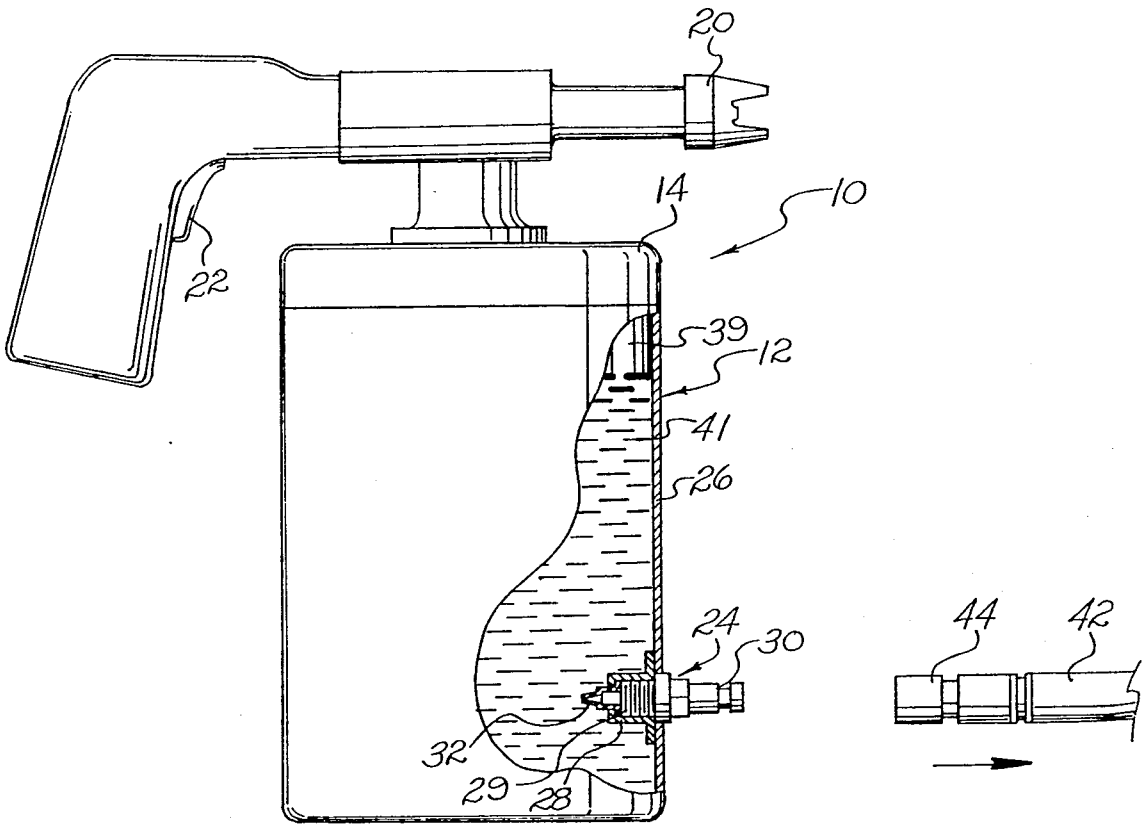
FIG. 6 is an elevational view showing completion of the filling step.

Receptacle 12 includes a filling check valve 24 mounted in receptacle sidewall 26. Check valve 24 prevents chemical solutions within receptacle 12 from backfilling into a hose or the like being used to fill receptacle 12 with liquid. This is particularly important where the liquid is water being supplied by the home water system. Receptacle 12 includes a mounting bracket 28 secured to the inner part of receptacle sidewall 26. A male quick connect coupler 30 of conventional construction is threadably secured to bracket 28 and seals receptacle 12 against fluid leakage through check valve 24 to the outside. A duck bill valve 32 seen in FIGS. 1–3 is secured between bracket 28 and coupler 30 as shown in FIGS. 4–7. Duck bill valve 32 is preferably a single piece one-way valve which includes a continuous base foot 34 and a body 36. Valve body 36 includes walls 37 of generally converging cross-sectional shapes shown in FIG. 3 and terminates in a slit outlet 38. Because of the converging body walls 37, fluid under pressure may travel through slit outlet 38 only in the direction of arrow 40 but may not enter valve body 36 from the other direction.

Figure 7:
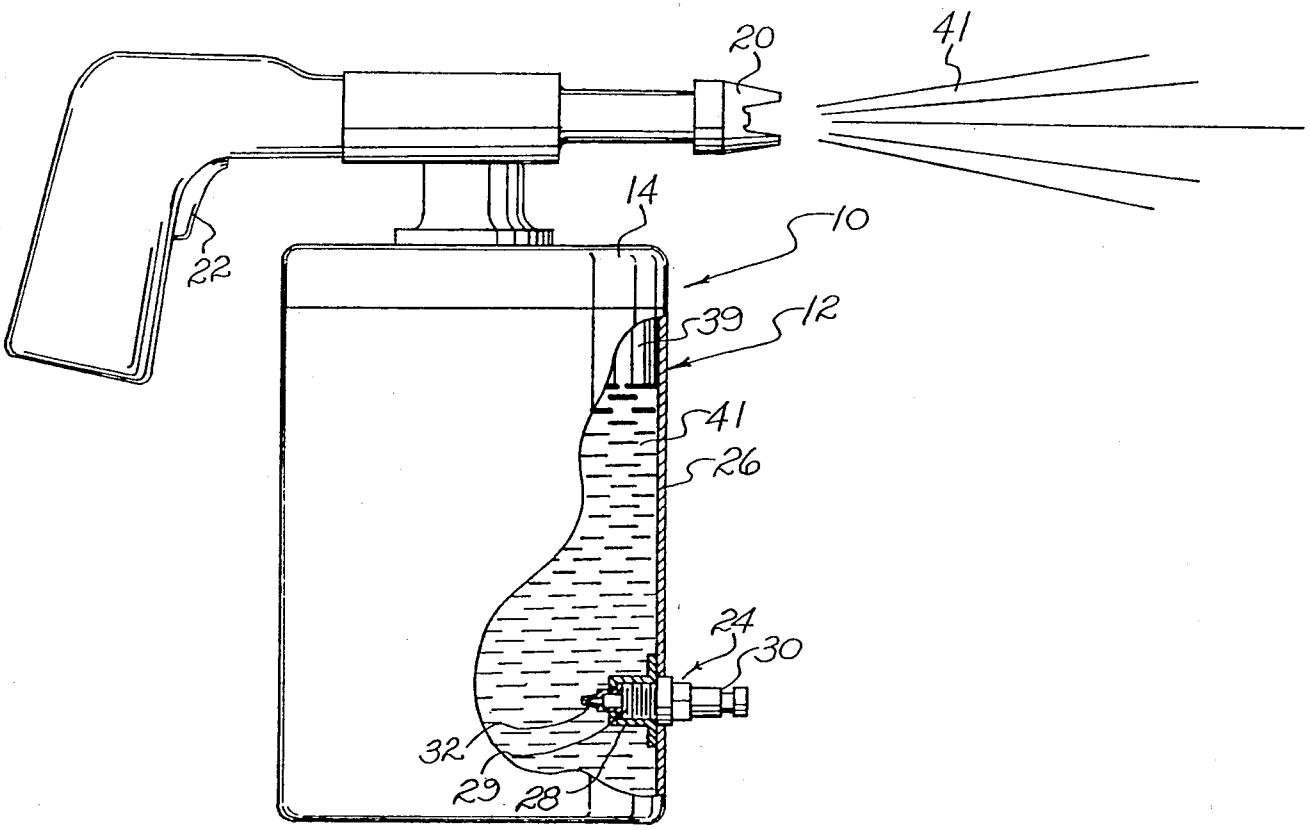
FIG. 7 is an elevational view showing the sprayer in action.

FIGS. 4–7 illustrate the sprayer in use. First, closure cap 14 is removed and receptacle 12 filled with a quantity of a substance such as concentrated liquid or solid powdered chemicals 37 (FIG. 4 . Receptacle sidewall 26 may include indicator lines to inform the user (not shown) when the correct level has been reached. Closure cap 14 is then sealed, and a hose 42 is connected for delivery of diluent (in this case water) to receptacle 12 by a female quick connect coupler 44 which is snap-fitted over male quick connect coupler 30. Fluid under pressure is charged through hose 42 and through one-way valve 32 (FIG. 5) into receptacle 12, and compresses the air 39 which previously occupied the receptacle. After filling to a predetermined level, hose 42 is disconnected (FIG. 6) from the receptacle 12. As shown in FIG. 7, sprayer 10 may then be utilized to deliver the fluid 41 in receptacle 12 under pressure to an outside source with the compressed air in the receptacle acting as the propellant. Receptacle 12 or closure cap 14 may include a closable port (not shown) for recharging the fluid in the receptacle when the compressed air propellant is exhausted.

ALTERNATIVE EMBODIMENTS

Figure 8:
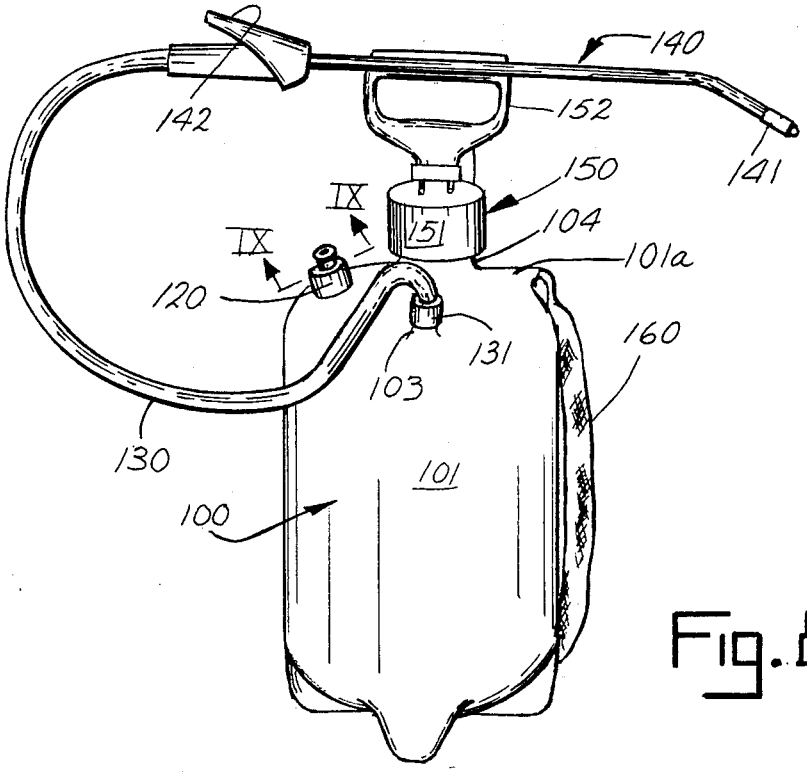
FIG. 8 is a perspective view of an alternative embodiment sprayer made in accordance with the present invention.
Figure 10:
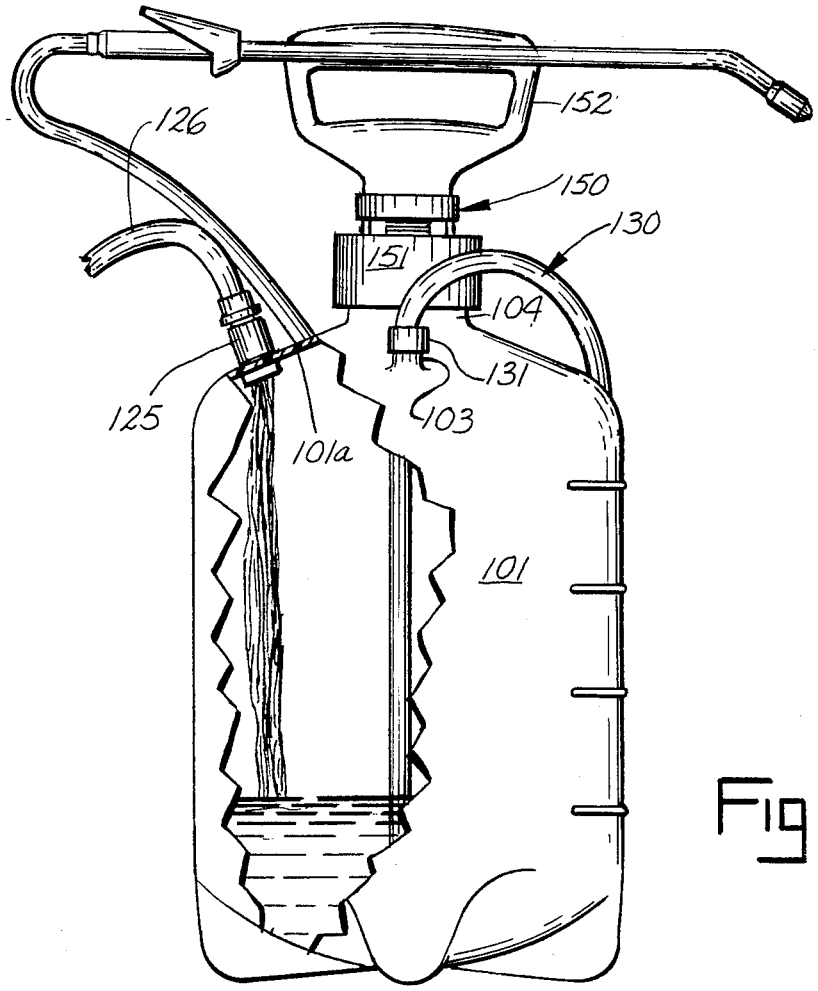
FIG. 10 is a partially broken view of the FIG. 8 sprayer being filled with liquid under pressure.
Figure 9:
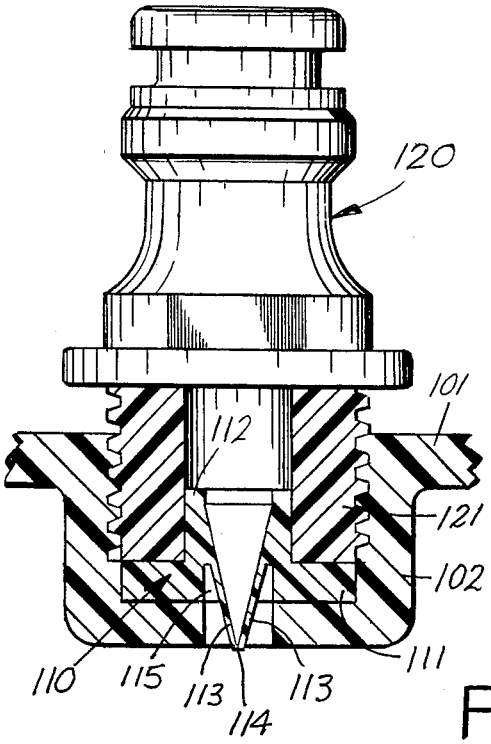
FIG. 9 is a fragmentary, cross-sectional view taken generally along plane IX—IX of FIG. 8.

The alternative embodiment sprayer 100 (FIG. 8) is of a somewhat larger, though still portable, variety, and, with the exception of the one-way valve per se, is the best mode presently contemplated by the inventor for the practice of the invention. It comprises a molded plastic container 101, preferably molded of polyethylene, which includes an integrally molded, threaded valve seat 102 for receiving a one-way valve assembly including one-way valve 110 and a quick disconnect hose coupler 120 (FIGS. 8 and 9). Container 101 also includes an integrally molded outlet fitting 103 to which delivery tube 130 is secured and an integrally molded threaded top opening 104 upon which the closure and hand pump assembly 150 is threadably mounted (FIGS. 8 and 10).

One-way valve 110 is made of a flexible rubber and comprises an annular shoulder 111 which surrounds and projects radially outwardly from a central, cylindrical body 112. Cylindrical body 112 projects in one direction away from shoulder 111 defining a relatively large inlet opening and then terminates in a duck bill flap arrangement 113 at approximately its juncture with that side of annular shoulder 111 from which it projects. Duck bill flaps 113 define a slit opening 114 therebetween where they come together. The cross section of converging flexible rubber walls 113 is sufficiently thin that they will flex apart slightly to allow fluid to flow therethrough in one direction, but will be compressed together so as to close slit 114 under back pressure within container 101. There is an annular recess 115 in shoulder 110 which surrounds duck bill flaps 113, thereby giving them additional flexibility for proper closure against the movement of fluids in the wrong direction through slit opening 114.

Duck bill valve 110 is seated within the recess defined by valve seat 102 and is held in position by threading hose coupler 120 into the integrally formed threads in valve seat 102. The threaded, cylindrical end 121 of quick disconnect hose coupling 120 seats on top of shoulder 111 of valve 110 and thereby traps it in position against the base wall of valve seat 102.

Quick disconnect hose coupler 120 is of a conventional quick disconnect configuration. It is adapted for quick disconnect mating to a quick disconnect coupler 125 which can be threaded onto the end of a conventional garden hose or the like 126 (FIG. 10).

Preferably, one-way valve 110 and hose coupler assembly 120 are positioned in the top wall **101*a* of container 101. This makes it easier to connect hose 126 via coupling 125 in that one can press downwardly against coupler 120 while container 101 is resting on the ground or other firm surface. If coupler 120 were located in the side of container 101, the user would have to hold container 101 against movement while pressing hose 126 and coupling 125 onto coupler 120**.

In all other respects, alternative embodiment sprayer 100 is conventional. A flexible delivery tube 130 is clamped over integrally molded outlet fitting 103 by means of a tube clamp 131. The other end of flexible delivery tube 130 is secured to a spray wand 140 which includes a spray nozzle 141 at one end and a valve assembly 142 at the other end.

A conventional hand pump assembly 150 including a threaded closure 151 is threaded over the threaded top opening 104 of container 101. Pump handle 152 includes an elongated groove integrally formed therein so that wand 140 can be seated in the groove for storage and transport. Handle 152 can be released for pumping to facilitate hand pressurization of container 101, or it can be locked in a down position to serve as a carrying handle for sprayer 100. Sprayer 100 can also be carried by the user over his shoulder by means of a carrying strap 160 suitably fastened to container 101.

Hand pump assembly 150 serves not only as a closure for receptacle 101, but also makes it possible to repressurize receptacle 101 when the user is remote from the source of liquid under pressure which is being used. Thus a homeowner spraying chemicals on his lawn might be at a remote location from the hose and still have some chemical solution remaining in container 101. He can simply use hand pump 150 to repressurize receptacle 101 and finish using the solution therewithin.

To pressurize container 101 of sprayer 100, a hose 126 connected to a pressurized source of the liquid to be sprayed is coupled to quick disconnect coupler 120 by means of its mating quick disconnect coupler 125. Coupler 125 is preferably of the conventional type which automatically allows the fluid under pressure to pass when it is coupled to coupling 120. If the fluid is water and one desires to spray a solution of chemicals, the chemicals are first introduced into container 101 through top opening 104 by simply unthreading top closure 151 and removing pump/handle assembly 150. With the solid or liquid chemicals introduced into container 101, closure 151 is again threaded onto threaded top opening 104 and hose 126 is coupled as described above.

Typically, container 101 will be filled with water coupled to a house or industrial water system. Usually, the pressure of such water is a fairly predictable 60 to 70 psi. However for use in conjunction with higher pressure systems or systems where the pressure may fluctuate, an alternative embodiment, automatic shut off valve assembly 200 is provided (FIGS. 11 and 12) in place of one-way valve 110 and hose coupler 120. In this embodiment, the integrally molded valve seat 102 of container 10 does not include internal threads. Rather, it includes an upwardly projecting, integrally molded sleeve **102*a* having integrally molded external threads upon which can be threaded a valve closure cap 201. Valve closure cap 201 includes a central opening which telescopingly receives a hose coupling stem 202, which includes a central fluid flow passage 203. Passage 203 terminates at the bottom in a lateral passage 204 which in turn feeds into an annular passage 205 around the base of coupling stem 202. Annular passage 205 is defined by a pair of annular shoulders 206 projecting from the base of coupling stem 202 on either side of annular passage 205. Each annular shoulder 206 and 207 includes a groove formed therein for receiving top and bottom O rings 208 and 209** respectively.

Positioned between telescoping coupling stem 202 and the interior wall of externally threaded sleeve **102*a* is a sleeve 210 having an outwardly radiating top flange 211 which seats on the top edge of threaded sleeve 102*a* and is held in place by top threaded closure 201. Sleeve 210 includes a plurality of vertical grooves or passages 212 which extend from the bottom of sleeve 210 upwardly a portion of the distance towards the top thereof. When telescoping coupling 202 is in the position show in FIG. 11, annular passage 205 is in flow communication with vertical groove passages 212. This allows fluid under pressure to flow in through central passage 203, lateral passage 204, annular passage 205 and downwardly through vertical passageways 212 into the space below telescoping coupling stem 202. From thence fluid can flow through the opened top of a one-way duck bill valve 110***a* which is very similar to duck bill valve 110 previously described. One-way duck bill valve 110*a* is held in position by means of a washer 230 seated over shoulder flange 111 of valve 110*a* and held down by the lower terminal end of sleeve 210. Washer 230 includes upwardly projecting dimples 231 which insure that there will be a fluid flow passage between the bottom of telescoping stem 202 and the top of washer 230 even when telescoping stem 202 is in its bottom most position as shown in FIG. 11, thereby allowing fluid to flow over washer 230 and into the opened top of duck bill valve 110*a*.

Figure 11:
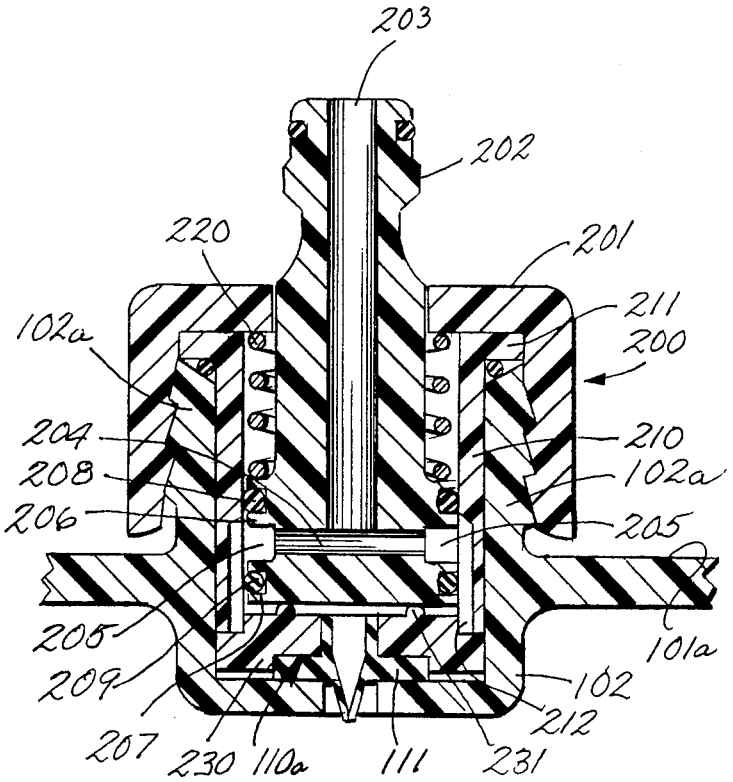
FIG. 11 is a cross-sectional view of an alternative embodiment fill valve.
Figure 12:
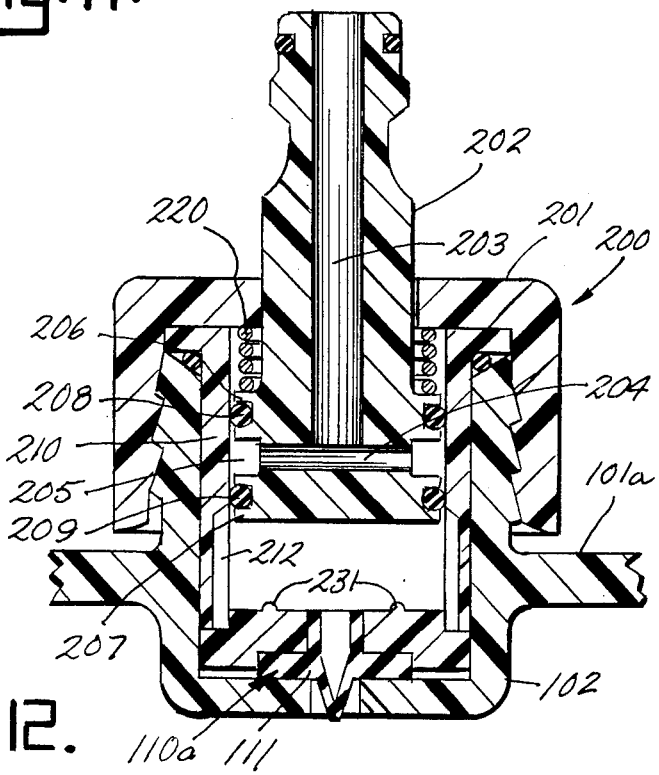
FIG. 12 is a cross-sectional view of the valve of FIG. 11 after a predetermined pressure level has been achieved within the sprayer.

Coupling stem 202 is biased downwardly into the position illustrated in FIG. 11 by means of a coil spring 220 extending between the under surface of the top of closure 201 and the upper surface of upper annular shoulder 206. However when back pressure begins to build up at the base of telescoping coupling stem 202, stem 202 is forced upwardly until, when it is in the position illustrated in FIG. 12, annular passage 205 is sealed from vertical groove passages 212 by means of the bottom O ring 209 in bottom annular shoulder 207. This prevents any further flow of fluid into container 101 and prevents container 101 from being overpressurized. Typically, coil spring 220 will be selected such that a back pressure of between 70 and 80 pounds will close valve assembly 200 and prevent further pressurization of container 101.

Figure 13:
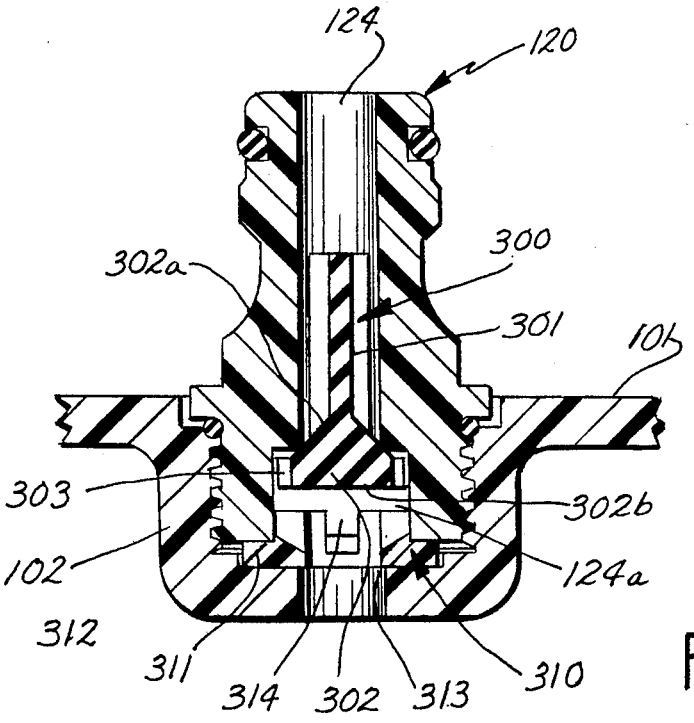
FIG. 13 is a cross-sectional view of yet another alternative embodiment fill valve for us in the present invention.

FIG. 13 illustrates a one-way valve alternative to the use of duck bill valve 110 or 110*a* which alternative is currently believed to be the best mode one-way valve for use in the present invention. Basically, duck bill valve 110 is replaced by a poppet valve 300 combined with a flow maintaining valve stop 310. Poppet valve 300 is axially movably received within the internal passage 124 of hose coupler 120 and flow maintaining valve stop 310 is held in place in the base of valve seat 102 by hose coupling 120 being threaded into valve seat 102 over valve stop 310.

Poppet 300 includes a stem 301 comprised of intersecting flanges, giving it a "X" shaped cross section which keeps poppet 300 properly oriented as it moves within passage 124, but still allows water to flow around stem 301. It is made of rubber with a Shore A durometer of 65–90, preferably 80±5.

Stem 301 is connected to the valve head 302 which includes a cone shaped upper surface 302 defining a valve seat. Head 302 is larger in diameter than the base of passageway 124 so that it seats on the base of passage 124 and blocks the flow of liquid or air therethrough.

The base of passage 124 opens into a larger chamber 124*a* at the base of hose coupler 120. Poppet head 302 is larger in diameter than passage 124, but is not as large in diameter as the internal diameter of chamber 124*a*. Ribs 303 project radially from the perimeter of head 302 to help keep poppet 300 centered by their engagement with the walls of chamber 124*a*, without blocking the flow of fluid around head 302.

Head 302 includes a flat bottom 302*b* which, when one connects hose coupler 120 to a source of fluid under pressure, gets forced down and seats on top of valve stop 310.

Valve stop 310 comprises basically a shoulder washer having an annular projecting shoulder 311 projecting radially from a main cylindrical body 312 which includes a central opening 313 extending therethrough in alignment with the opening in the base of valve seat 102. A plurality of radial channels 314 are cut into the top of the main cylindrical body 312 and communicate with central opening 313 so that even when the bottom 302*b* of valve head 302 is seated on top of valve stop 310, water can flow around valve head 302, past radiating ribs 303, through channels 314 and into passageway 313, thereby allowing fluid to flow into the interior of container 101. On the other hand once container 101 is pressurized and the source of pressurized fluid is uncoupled from hose coupler 120, pressure within container 101 will push poppet 300 upwardly so that the conical upper surface 302*a* of its head 302 seats against the base of coupler passageway 124, thereby preventing the flow of air or liquid back around valve head 302 to the exterior of container 101.

Of course, it is understood that the above is merely a preferred embodiment of the invention and that various changes and alterations can be made without departing from the spirit and broader aspects thereof.

The embodiments of the invention in which an exclusive property or privilege is claimed are defined as follows:

1. In a portable sprayer for dispensing water or water solutions under pressure, said sprayer comprising a closed receptacle for containing water or water solutions under pressure, said receptacle including a dispensing outlet operably connected to dispensing valve means which can be opened to dispense water or water solutions under pressure or closed to seal said container, said receptacle including a resealable closure which can be opened to allow the insertion of chemicals into said container and then reclosed and resealed to allow pressurization through the introduction water under pressure;

a one-way valve extending from outwardly of said receptacle to inside the receptacle, said one-one valve including a nonthreaded quick disconnect fitting operably connected thereto for connection to a nonthreaded quick disconnect hose coupling on a water hose and comprising means for allowing entry of water into said receptacle while preventing backflow out of said receptacle, whereby said receptacle is pressurized during entry of water into said receptacle when said dispensing valve means is closed;

said container including a bottom, a sidewall and a top wall, said one-way valve, including said nonthreaded quick disconnect fitting being located in said top wall separately from said releasable closure whereby one can connect a nonthreaded quick disconnect hose coupling to said nonthreaded quick disconnect fitting by pressing downwardly with said receptacle being seated on a firm surface.

2. The sprayer of claim 1 which additionally includes hand pump means mounted in said releasable closure whereby said sprayer can alternately be pressurized by means of said hand pump means.

3. The sprayer of claim 2 which includes a pressure limiting valve operably associated with said one-way valve for limiting the extent to which said receptacle can be pressurized.

4. The sprayer of claim 3 wherein said one-way valve includes an intake bore closed at one end by inwardly converging flexible walls defining slit opening into said receptacle whereby liquid will flow from said bore through said slit, but whereby back pressure in said receptacle collapses said flexible walls toward one another preventing the escape of air under pressure through said slit.

5. The sprayer of claim 3 in which said one-way valve comprises a poppet valve axially movably located within said quick disconnect fitting for movement between an open position allowing fluid to flow therepast and a seated closed position preventing flow out of said container when pressurized.

6. The sprayer of claim 1 in which said one-way valve comprises a poppet valve axially movably located within said quick disconnect fitting for movement between an open position allowing fluid to flow therepast and a seated closed position preventing flow out of said container when pressurized.

7. The sprayer of claim 1 which additionally includes hand pump means whereby said sprayer can alternately be pressurized by means of said hand pump means.

8. The sprayer of claim 1 which includes a pressure limiting valve operably associated with said one-way valve for limiting the extent to which said receptacle can be pressurized.

9. The sprayer of claim 1 wherein said one-way valve includes an intake bore closed at one end by inwardly converging flexible walls defining a slit opening into said receptacle whereby liquid will flow from said bore through said slit, but whereby back pressure in said receptacle collapses said flexible walls toward one another preventing the escape of air under pressure through said slit.

10. The sprayer of claim 1 in which said one-way valve comprises a poppet valve.

11. A method of dispensing a water dissolved or diluted chemical in a portable sprayer which comprises the steps of:

(a) placing a concentrated chemical in a portable receptacle having a resealable closure, a dispensing outlet operably connected to dispensing valve means which can be opened to dispense liquid under pressure or closed to seal said container and a one-way valve, said one-way valve including a nonthreaded quick disconnect fitting operably connected thereto whereby a hose and nonthreaded quick disconnect hose coupling can be readily quick connected and quick disconnected to said quick disconnect fitting;

(b) sealing said closure to entrap air in said receptacle with said concentrated chemical;

(c) connecting said one-way valve to a water tap through a hose and nonthreaded quick disconnect hose coupling;

(d) introducing water from said water tap into said receptacle through said one-way valve wherein said entrapped air pressurizes a solution of said concentrated chemical and water;

(e) disconnecting said hose from said one-way valve prior to dispensing said solution; and (f) dispensing said solution through said receptacle dispensing outlet, using said entrapped air as propellant for dispensing the solution.

12. The method of claim 11 wherein step c) includes connecting said one-way valve to a home water source through said hose and nonthreaded quick disconnect hose coupling.

13. The method of claim 11 which includes additionally providing said receptacle with had pump means, and repressurizing said receptacle by pumping said hand pump means when the pressure created as a result of introducing said diluent liquid under pressure into said receptacle has dissipated.

14. The method of claim 11 which includes locating said one-way valve and its said nonthreaded quick disconnect fitting in the top of said portable receptacle, connecting said nonthreaded quick disconnect hose coupling to said fitting by forcing said hose coupling down over said fitting while said receptacle is resting on a support surface, and allowing said support surface to hold said portable receptacle in place against the force exerted there against by reason of forcing said hose coupling over said fitting.

15. A method for dispensing water in a portable sprayer which comprises the steps of:

(a) providing a portable receptacle having a dispensing outlet operably connected to dispensing valve means which can be opened to dispense water under pressure or closed to seal said receptacle, and a one-way valve, said one-way valve including a nonthreaded quick disconnect fitting operably connected thereto whereby a hose and nonthreaded quick disconnect hose coupling can be readily quick connected and quick disconnected to said quick disconnect fitted;

(b) closing said dispensing valve means to entrap air within said receptacle;

(c) connecting said one-way valve to a water tap through a hose and nonthreaded quick disconnect hose coupling;

(d) introducing water from said water tap into said receptacle through said one-way valve whereby said entrapped air pressurizes said water within said receptacle;

(e) disconnecting said hose from said one-way valve prior to dispensing said solution; and (f) dispensing said water through said receptacle dispensing outlet using said entrapped air as propellent for dispensing said water.

16. The method of claim 15 wherein step (c) includes connecting said one-way valve to a home water source through said hose and nonthreaded quick disconnect hose coupling.

17. The method of claim 16 which includes additionally providing said receptacle with hand pump means, and repressurizing said receptacle by pumping said hand pump means when the pressure created as result of introducing said diluent liquid under pressure into said receptacle has dissipated.

18. The method of claim 15 which includes additionally providing said receptacle with hand pump means, and repressurizing said receptacle by pumping said hand pump means when the pressure created as a result of introducing said diluent liquid under pressure into said receptacle has dissipated.

19. The method of claim 15 which includes locating said one-way valve and its said nonthreaded quick disconnect fitting in the top of said portable receptacle, connecting said nonthreaded quick disconnect hose coupling to said fitting by forcing said hose coupling down over said fitting while said receptacle is resting on a support surface, and allowing said support surface to hold said portable receptacle in place against the force exerted there against by reason of forcing said hose coupling over said fitting.

* * * * *

UNITED STATES PATENT AND TRADEMARK OFFICE

CERTIFICATE OF CORRECTION

PATENT NO. : 4,782,982

DATED : November 8, 1988

INVENTOR(S) : Garry L. Ellison

It is certified that error appears in the above-identified patent and that said Letters Patent is hereby corrected as shown below:

Column 2, line 9:

"us" should be --use--.

Column 4, line 48:

"container 10" should be --container 101--.

Column 6, claim 1, line 45:

"one-one" should be --one-way--.

Column 8, claim 13, line 3:

"had" should be --hand--.

Column 8, claim 15, line 29:

"fitted" should be --fitting--.

UNITED STATES PATENT AND TRADEMARK OFFICE

CERTIFICATE OF CORRECTION

PATENT NO. : 4,782,982

DATED : November 8, 1988

INVENTOR(S) : Garry L. Ellison

It is certified that error appears in the above-identified patent and that said Letters Patent is hereby corrected as shown below:

Column 8, claim 17, line 50:

After "as" insert --a--.

Signed and Sealed this

Twenty-third Day of May, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,782,982

DATED : November 8, 1988

INVENTOR(S) : Garry L. Ellison

It is certified that error appears in the above-identified patent and that said Letters Patent is hereby corrected as shown below:

Column 6, claim 1, line 58:

"releasable" should be --resealable--

Signed and Sealed this

Fifth Day of December, 1989

*Attest:*

JEFFREY M. SAMUELS

*Attesting Officer*

*Acting Commissioner of Patents and Trademarks*